US006951121B2

(12) United States Patent
Lee et al.

(10) Patent No.: US 6,951,121 B2
(45) Date of Patent: Oct. 4, 2005

(54) WASHING MACHINE HAVING FLOATAGE CLUTCH

(75) Inventors: Tae Hee Lee, Seoul (KR); Jin Woong Kim, Gwangmyung-si (KR); Si Moon Jeon, Seoul (KR)

(73) Assignee: LG Electronics INC, Seoul (KR)

( * ) Notice: Subject to any disclaimer, the term of this patent is extended or adjusted under 35 U.S.C. 154(b) by 126 days.

(21) Appl. No.: 10/059,313

(22) Filed: Jan. 31, 2002

(65) Prior Publication Data

US 2003/0051516 A1 Mar. 20, 2003

(30) Foreign Application Priority Data

Sep. 19, 2001 (KR) ..... 2001-57840

(51) Int. Cl.[7] ..... D06F 37/40

(52) U.S. Cl. ..... 68/12.02; 68/12.14; 68/12.19; 68/133

(58) Field of Search ..... 68/12.02, 12.05, 68/12.14, 12.19, 12.21, 23.5, 23.6, 24, 132, 133

(56) References Cited

U.S. PATENT DOCUMENTS 3,832,870 A * 9/1974 Todd-Reeve
5,150,589 A * 9/1992 Williams et al.
5,586,455 A * 12/1996 Imai et al.
5,595,072 A * 1/1997 Bai et al.
5,651,277 A * 7/1997 Richardson
5,661,990 A * 9/1997 Chong
5,718,130 A * 2/1998 Kim
5,765,406 A * 6/1998 Youn
5,829,276 A * 11/1998 Suh et al.
5,874,904 A * 2/1999 Youn
5,916,275 A * 6/1999 Chung
5,921,113 A * 7/1999 Lee et al.
5,946,947 A * 9/1999 Lee et al.

FOREIGN PATENT DOCUMENTS

JP 1999-0079507 11/1999

* cited by examiner

*Primary Examiner*—Frankie L. Stinson
(74) *Attorney, Agent, or Firm*—Birch, Stewart, Kolasch & Birch, LLP

(57) ABSTRACT

The present invention relates a washing machine of direct drive pulsator manner that is directly connected to a motor. In this washing machine, the conversion of cleansing/dehydrating processes can be smoothly achieved by a floatage clutch capable of being actuated by floatage and gravity to be induced during the supply/drain of water.

12 Claims, 4 Drawing Sheets

WASHING MACHINE HAVING FLOATAGE CLUTCH

BACKGROUND OF THE INVENTION

1. Field of the Invention

The present invention relates to a washing machine, more particularly, to a washing machine having a floatage clutch that perform's the intermittence of power in cleansing and dehydrating operations by using the floatage thereof.

2. Description of the Related Art

Generally speaking, washing machines are used to clean, rinse, and dehydrate clothes and the like by using a mechanical operation via an electric driving motor. The washing machine includes a cleansing part for performing a cleansing work, and a driving part for driving the cleansing part. The washing machines can be classified into agitator type washing machines, drum type washing machines, and pulsator type washing machines according to a cleansing manner of the cleansing part.

The cleansing part of the pulsator type washing machine as described above, as shown in FIG. 1, includes a water tub 12 installed in a case 10, a cleansing basket 14 rotatably contained in the water tub 12, a pulsator 16 disposed at the bottom of the cleansing basket for forming a water stream, a water tab 17, and a drain valve 18. The cleansing basket 14 is punched with numerous dehydration holes 14*a* in a sidewall thereof.

In addition, the driving part includes a driving motor 20, a transmission 30 and a clutch mechanism 40 for driving the pulsator 16 and the cleansing basket 14 by receiving a driving force of the driving motor 20, a belt connection means for transferring the driving force of the driving motor 20 to the clutch mechanism 40, and a brake means for maintaining the stable fixed state of the transmission 30.

As shown in FIG. 2, the transmission 30 includes a gear box 32, an upper and lower pulsator shafts 33 and 34 connected each other via a gear means disposed within the gear box 32, and a spin shaft 35 fixed to the gear box 32 (See FIG. 4). The upper pulsator shaft 33 is designed to be rotatably fitted in the spin shaft 35 and connected to the pulsator 16. The spin shaft 35 is connected to the cleansing basket 14 and fixed to the gear box 32. The lower pulsator shaft 34 is formed with a serration part 341 on the lower end thereof and constructed to be protruded exceeding the gear box 32 downwardly (See FIG. 3.).

As shown in FIG. 3, the clutch mechanism 40 includes a spin shaft block 42 fixed to the lower end of the gear box 32, a spring block 46 disposed on the one side of the spin shaft block 42, which is engaged with the serration part 341 of the lower pulsator shaft 34 and fixed to a pulley 44 of the belt connection means, and an one-way spring 48 disposed to be surrounded the spin shaft block 42 and the spring block 46 (See FIG. 1). Here, a tight fastening state and a releasing state of the one-way spring 48 is controlled according to the rotating direction thereof.

In addition, as shown in FIG. 4, the gear means constructed in the gear box 32 of the transmission 30 includes a pinion gear 50 attached to the lower end of the upper pulsator shaft 33, an eccentric crank 52 formed with a rack gear portion 521 to be engaged with the pinion gear 50, a first gear 54 disposed on the same rotating axial line to be engaged with the eccentric crank 52, and a second gear 56 attached to the upper end of the lower pulsator shaft 34 to be engaged with the first gear 54.

The brake means includes a brake disk 60 disposed under the gear box 32, a brake fictional portion 62 formed on the top surface of a frame 19 of suspension means, which has a corresponding shape to the brake disk 60, and position adjustment means (not shown) for controlling the separation and contact states between the brake disk 60 and the brake frictional portion 62 by vertically adjusting the position of the gear box 32 according to the operating direction of the driving motor 20 (See FIG. 1).

A washing process of the pulsator type washing machine constructed as described above includes the following steps in order: 1) a water supply step for supplying water into the cleansing basket 14 through the water tab 17; 2) a cleansing step for circulating the water and laundry during a desired time via the rotating operation of the pulsator 16; 3) a rinsing step for rinsing the laundry as much as certain times by supplying clear rising water not containing any detergents after draining the water through the drain valve 18; and 4) a dehydrating step for driving the cleansing basket 14 at a high speed to dehydrate the laundry.

In the water supply step of the washing process, the water just entered through the water tab 17 is changed into a cleansing water containing a detergent with by passing in a detergent container. Also, in the cleansing step, a removal work of contaminants clinging to the laundry is performed under a chemical operation of detergent contained in the cleansing water as well as a physical operation of the pulsator 16. The pulsator 16 is repeatedly rotated, that is intermittently reversed, in forward and backward by the transmission 30, so that a both directional water stream composed of a left-and-right water stream and an up-and-down water stream can be formed to effectively perform the cleansing work of the laundry.

Then, in a state that the clear rinsing water not containing the detergent is supplied during the rinsing step, the detergent clinging to the laundry is also effectively removed by using the both directional water streams formed by the rotation of the pulsator 16 in the same manner with the cleansing step. Finally, in the dehydrating step, the cleansing basket 14 is rotated in one direction at a high speed after the rinsing water is completely drained, then the water contained in the laundry can be discharged via the dehydration holes 14*a* due to centrifugal force. In this case, the laundry is tightly contacting with the inner wall of the cleansing basket 14.

In the dehydrating step, since the cleansing basket 14 and the pulsator 16 are simultaneously rotated in the same direction, it is possible to prevent the damage of the laundry from being caught to the pulsator 16. Also, the water discharged through the dehydration holes 14*a* of the cleansing basket 14 is drained out of the washing machine as soon as the drain valve 18 is opened.

Meanwhile, the rotating operation of the cleansing basket 14 and the pulsator 16 in all steps are performed by the driving part as described above. The operation of the driving part will be explained in detail as follows.

First of all, in the cleansing step, the pulley 44 is rotated in clockwise direction by the driving force of the driving motor 20, and then the spring block 46 connected with the pulley 44 and the lower pulsator shaft 34 coupled with the serration portion of the spring block 46 are rotated. At this time, the one-way spring 48 loosened, and since the brake disk 60 and the brake frictional portion 62 are in tightly contact with each other, so the gear box 32 is in a fixed state. In addition, as the lower pulsator shaft 34 is rotated, the first gear 54 engaged with the second gear 56 and the second gear 56 within the gear box 32 are rotated, and at the same time, the eccentric crank 52 disposed on the same rotating axial line of the first gear 54 is actuated.

In this case, the eccentric crank 52 is linearly reciprocated about the rotating axial line due to the structural feature thereof then the upper pulsator shaft 33 can be reciprocated by the pinion gear 50 engaged with the rack gear portion 521 of the eccentric crank 52, and consequently the pulsator 16 can be achieved in the forward and backward rotation.

Additionally, in the dehydrating step, the driving motor 20 is rotated in counterclockwise direction in opposite to the cleansing step, and the spring block 46 connected with the pulley 44 and the lower pulsator shaft 34 coupled with the spring block 46 are rotated in counterclockwise direction. In this case, the one-way spring 48 is fastened so that the spring block 46 and the spin shaft block 42 can be coupled, and the brake disk 60 and the brake frictional part 62 are separated by the operation of the position adjustment mechanism. Therefore, the gear box 32 and the spin shaft 35 are rotated with the spin shaft block 42. Since, the upper pulsator shaft 33 is rotated in the same direction, then the cleansing basket 14 and the pulsator 16 are rotated at the same time to perform a dehydrating work.

According to the related pulsator type washing machine, because the pulsator 16 is rotated in forward and backward to generate the complex water stream, the effect of cleansing is relatively high. And, the conversion from the cleansing step to the dehydrating step is automatically performed due to the conversion of operating direction of the driving motor 20 and the linking structure of the transmission 30 and the clutch mechanism 40.

However, substantial problems exist in this related construction. First of all, the structures of the transmission 30 and the clutch mechanism 40 for transferring the driving force of the driving motor 20 to the pulsator 16 and the cleansing basket 14 have complex structures, which deteriorates the productivity of the washing machine. Also, since the cleansing work is performed only by the simple forward and backward rotation of the pulsator 16, it is impossible to achieve various cleansing operations suitable for the feature of the laundry, thereby deteriorating a merchant ability of the washing machine.

SUMMARY OF THE INVENTION

The present invention has been made to overcome the above-described problems. Accordingly, it is an object of the present invention to provide a washing machine having a floatage clutch, which can smoothly switch the power transmission in the conversion from the cleansing step to the dehydrating step by using the floatage thereof, and which can secure the stability of the switching process.

To achieve the above objects, there is provided a washing machine comprises a water tub; a cleansing basket rotatably contained within the water tub; a pulsator rotatably mounted on the bottom surface of the cleansing basket, having a wing part for forming a water stream, and a hub part disposed in the center of the wing part; a motor for generating a driving force required to rotate the cleansing basket and the pulsator; a transmission for transmitting the driving force of the motor to the cleansing basket and the pulsator, having a hollow dryer shaft integrated to the cleansing basket; and a washing shaft mounted to penetrate the hollow dryer shaft, whose upper end of the transmission is fixed to the hub part of the pulsator, and whose lower end thereof is connected with the motor; and a floatage clutch for allowing the cleansing basket to selectively cooperate with the pulsator by being intermittently actuated depending on the existence and nonexistence of water, having a float engaged with the washing shaft to be capable of moving up and down due to the supply/drain of the water, and a fixed member fixed to the upper end of the hollow dryer shaft to be separated from and coupled with the float at the lower side thereof.

The shielding means is shaped as a ring to be protruded at the bottom of the wing part of the pulsator exceeding the cleansing basket downwardly, and includes a water blocking part surrounding the float.

DETAILED DESCRIPTION OF THE PREFERRED EMBODIMENTS

Figure 1:
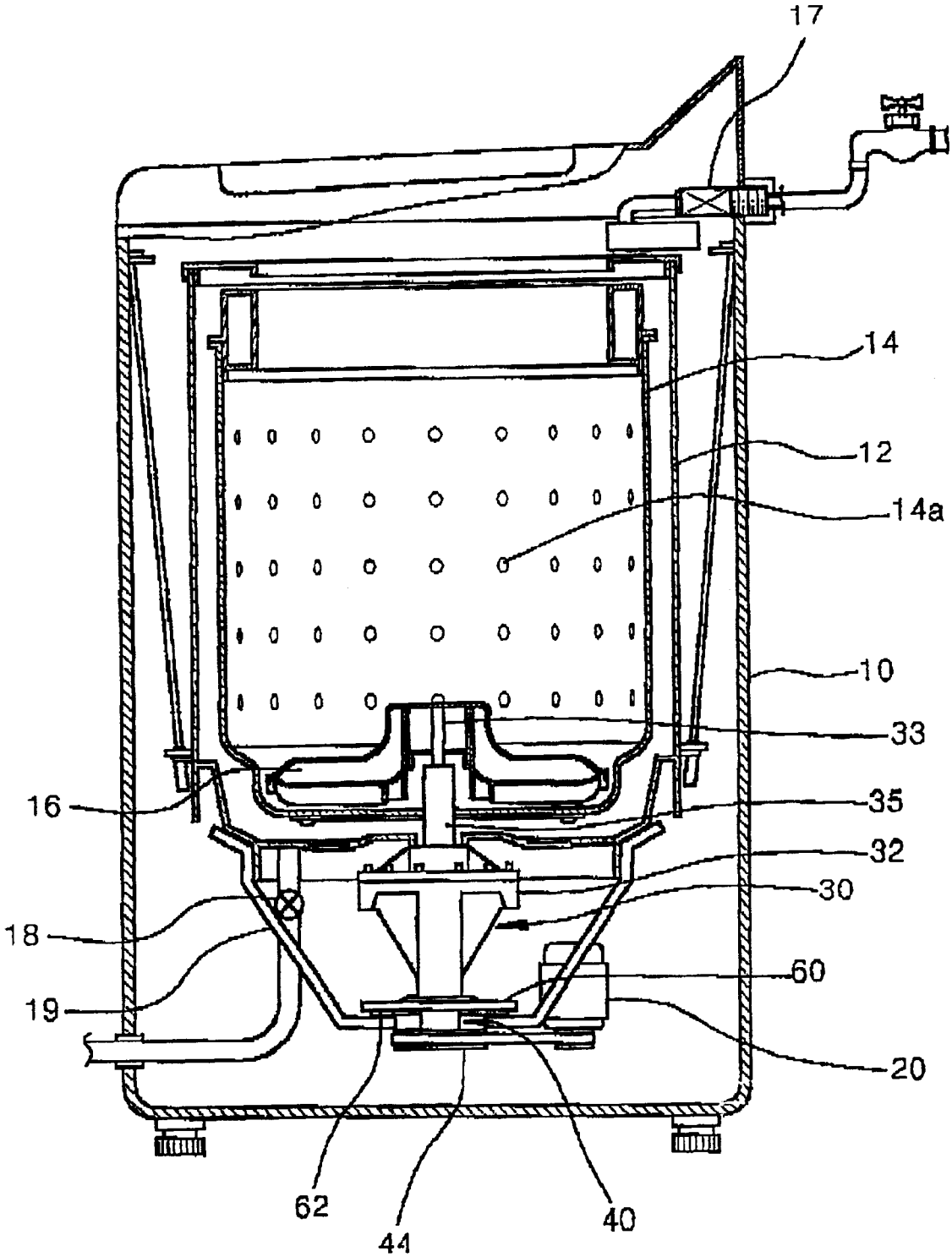
FIG. 1 (Related Art)
FIG. 1 is a cross sectional view illustrating the construction of a related washing machine.
Figure 2:
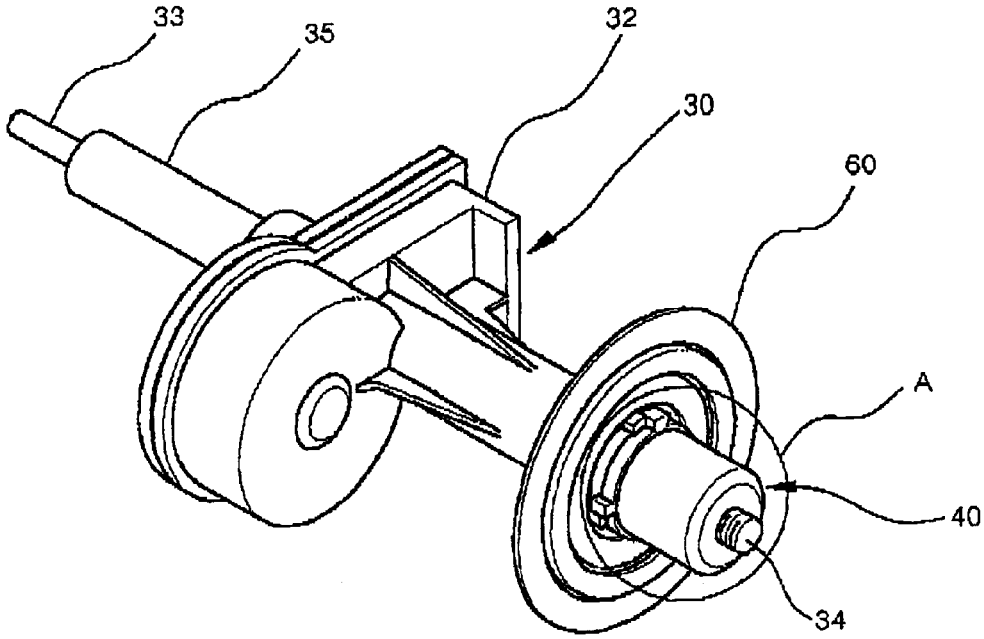
FIG. 2 is a perspective view illustrating the construction of a transmission of the related washing machine.
Figure 3:
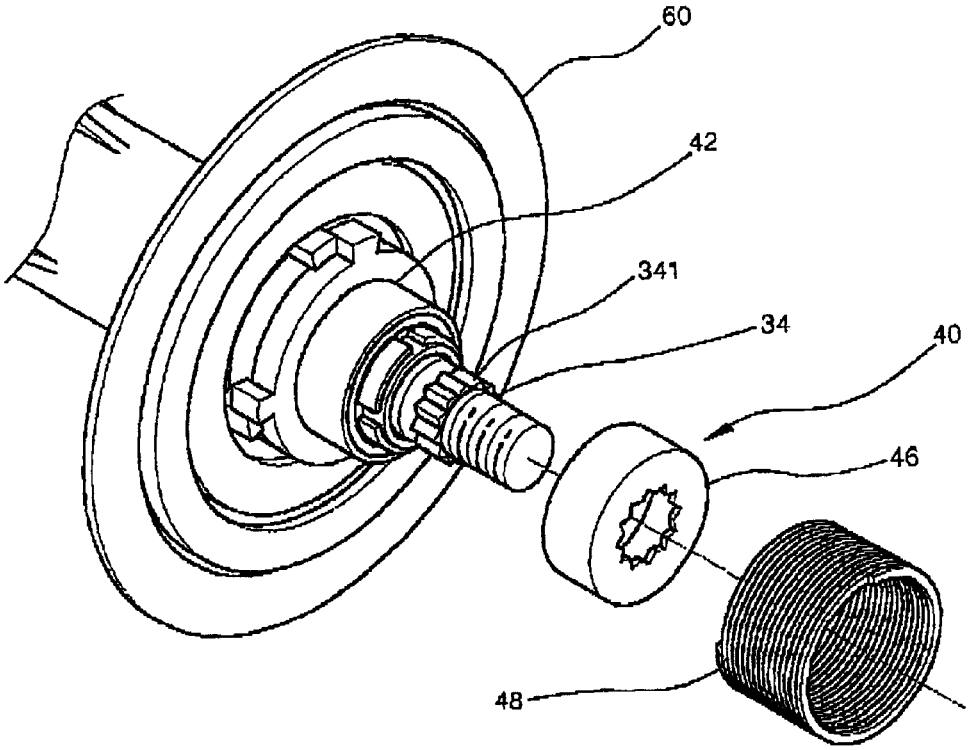
FIG. 3 is an exploded perspective view illustrating the construction of a clutch mechanism of the related washing machine.
Figure 4:
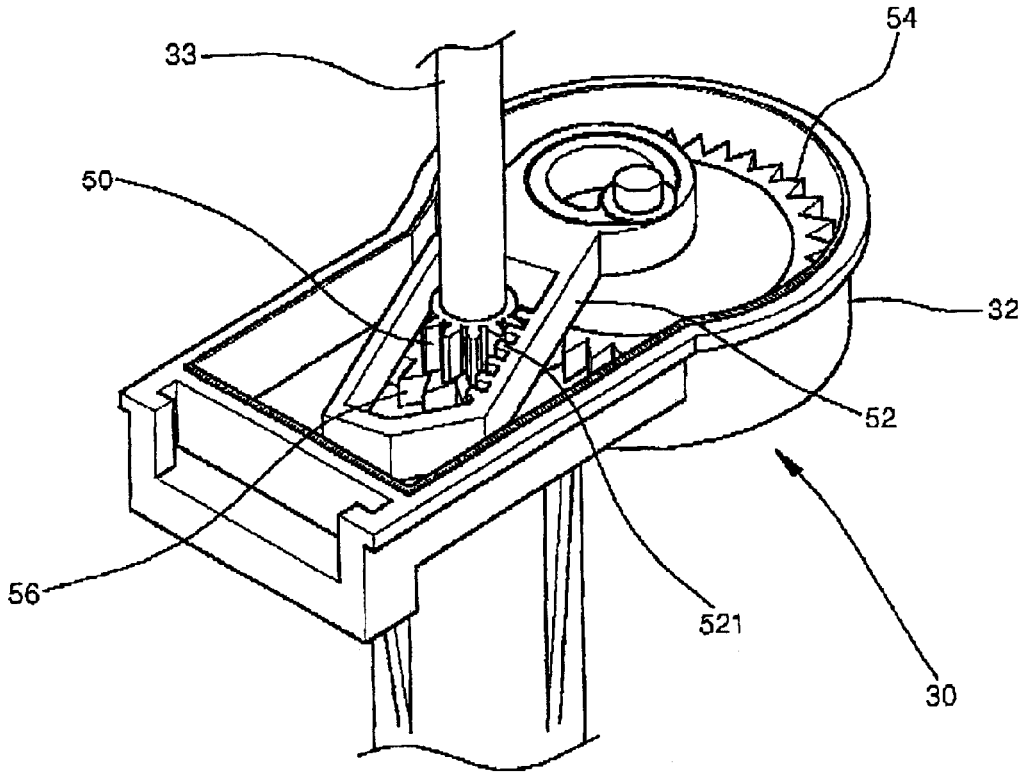
FIG. 4 is a perspective view illustrating the construction of gear means applied in the transmission of the related washing machine.

An embodiment of the present invention will now be described in more detail with reference to FIG. 5 and FIG. 6. In the following description, same drawing reference numerals are endowed in the same parts with the related construction.

Figure 5:
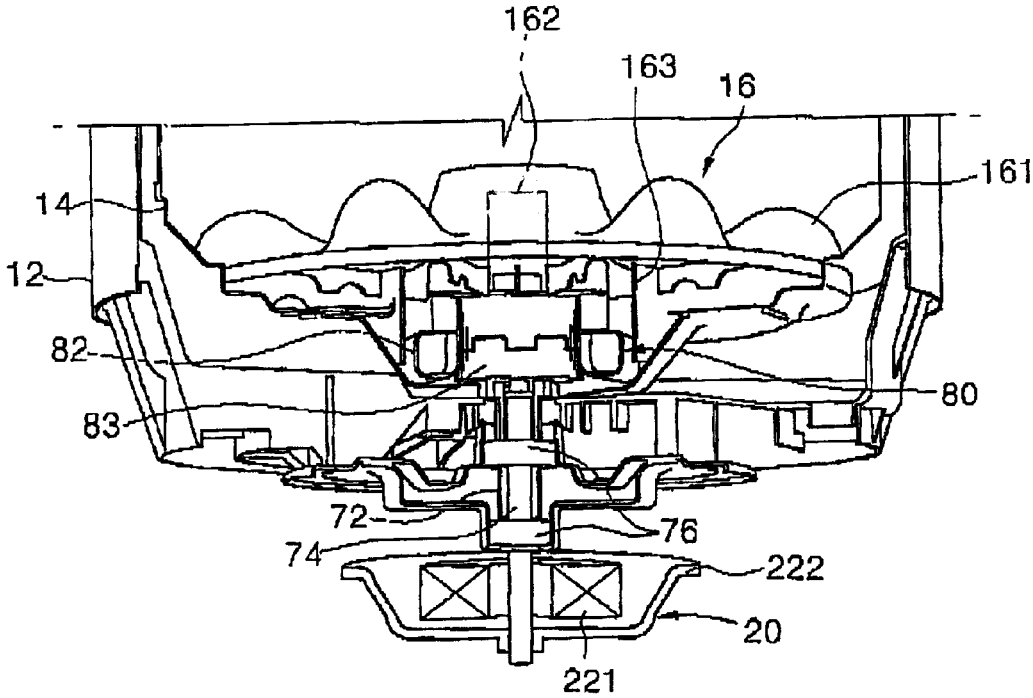
FIG. 5 is a perspective view illustrating the construction of essential parts of a washing machine in accordance with an embodiment of the present invention.
Figure 6:
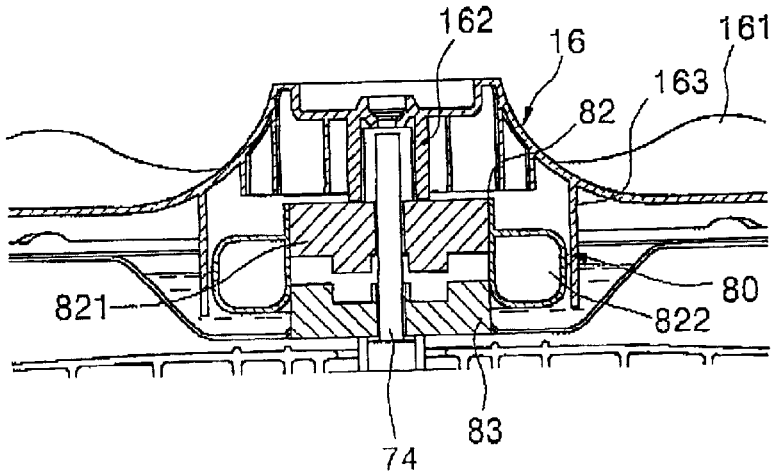
FIG. 6 is a state view illustrating the operation of the floatage clutch applied in the embodiment of the present invention.

First, FIG. 5 shows a washing machine in accordance with the embodiment of the present invention. The washing machine includes a water tub 12, a cleansing basket 14 contained within the water tub 12, a pulsator 16 rotatably mounted in the cleansing basket 14, a transmission 70 for controlling the rotating direction of the pulsator 16 and the cleansing basket 14; and a floatage clutch 80 for allowing the cleansing basket 14 to selectively cooperate with the pulsator 16 by being intermittently actuated depending on the existence and nonexistence of water.

Here, the pulsator 16 is rotatably mounted on the bottom surface of the cleansing basket 14, and includes a wing part 161 for forming a water stream, and a hub part 162 disposed in the center of the wing part 161.

The transmission 70 includes a hollow dryer shaft 72 integrated to the bottom surface of the cleansing basket 14, several bearings 76 supporting the hollow dryer shaft 72, and a washing shaft 74 mounted to penetrate the hollow dryer shaft 72. The upper end of the washing shaft 74 is fixed to the hub part 162 of the pulsator 16, and the lower end of the washing shaft 74 is connected with the motor 22.

In addition, the floatage clutch 80 includes a float 82 coupled with the washing shaft 74 to be capable of moving up and down, and a fixed member 83 fixed to the upper end of the hollow dryer shaft 72. The fixed member can be separated from and coupled with the float at the lower side of the float.

The float 82 includes a hub portion 821 to be coupled with a serration portion of the washing shaft 74, and a tube portion 822 constructed around the hub portion 821. The hub portion 821 of the float 82 is formed with a convex-concave shape bottom surface, and the tube portion 822 is shaped as a blinded hollow tube. Also, the fixed member 83 is formed with a convex-concave shape top surface to be engaged with the bottom surface of the hub portion 821 of the float 82.

Furthermore, the washing machine in accordance with the present embodiment comprises shielding means for partially shielding the joint region between the float 82 of the floatage clutch 80 and the washing shaft 74 in order to prevent the joint region from being contact with the water. The shielding means is shaped as a ring to be protruded at the bottom of the wing part 161 of the pulsator 16 exceeding the cleansing basket 14 downwardly, and includes a water blocking part 163 surrounding the tub portion 822 of the float 82.

The washing machine constructed as described above will be operated as follow.

First, if a given quantity of water is supplied into the cleansing basket 14 in the water supply step, the float 82 is floated up and separated from the fixed member 83 due to die floatage thereof as shown in FIG. 8*a*. The floatage clutch 80 is reached to a power cutoff state, so the driving force of the motor 22 is transferred only to the washing shaft 74.

In this power cutoff state of the floatage clutch 80, when the motor 22 is driven, only the pulsator 16 connected with the washing shaft 74 is rotated in the initial of the cleansing step. After that, the motor 22 is repeatedly driven in forward and backward, then the pulsator 16 also is rotated in forward and backward direction in the same manner with the motor. The motor and the pulsator is intermittently conversed in forward and backward rotation.

Due to the forward and backward rotation of the pulsator 16, a rotating water stream can be formed. Further, if the pulsator 16 is continuously rotated in one direction more than a certain time, the cleansing basket 14 is also rotated in the same direction with the pulsator by the water stream. Thus, the water can be discharged via dehydration holes 14*a* out of the cleansing basket 14 due to the centrifugal force. Furthermore, the discharged water can be again flown into the cleansing basket 14 through a fluid channel between the cleansing basket 14 and the water tub 12. This washing manner is designated as a centrifugal washing manner (so-called waterfall current washing manner).

The washing process is performed a cleansing step, a rinsing step, and a dehydrating step in order. Just before the dehydrating step, as the water used for rinsing laundry is drained, the floatage is gradually eliminated. Thus, as shown in FIG. 8*b*, the float 82 begins to drop by the weight thereof, and the hub portion 821 of the float 82 and the fixed member 83 are engaged with each other, so the floatage clutch 80 is switched into a power transmission state.

In this power transmission state of the floatage clutch 80, when the washing shaft 74 is driven by the motor 22, the float 82 engaged with the washing shaft 74 is rotated. At the same time, the fixed member 83 engaged with the hub portion 821 of the float 82 and the cleansing basket 14 coupled with the fixed member 83 also are rotated in the same direction with the washing shaft 74.

When the cleansing basket 14 is rapidly rotated in one direction and then the laundry becomes tightly contact with the inner wall of the cleansing basket 14, the water contained in the laundry can be discharged via the dehydration holes 14*a* due to the centrifugal force. The cleansing basket 14 and the pulsator 16 are simultaneously rotated in the same direction as described above, so it is possible to prevent the laundry from being caught to the pulsator, and consequently to prevent the damage of the laundry.

Meantime, in accordance with the present embodiment, a space above the float 82 to be closed by the water blocking part 163 is closed as the water is supplied during the cleansing step. Therefore, when the water invaded into the water blocking part 163, the float 82 is moved upwardly exceeding a desired distance due to floatage. Consequently, it is possible to prevent the water from being entered inside the water blocking part 163 any more due to the inner air pressure of the water blocking part 163.

In this way, since the tip end of the washing shaft 74 exposed out of the float 82 upwardly does not contact with the water even if the water is supplied, the operating stability of the floatage clutch 80 can be improved.

Since various foreign impurities fell down from the laundry are mixed in the water during the cleansing step, the various foreign impurities mixed in the water become interposed between the float 82 and the washing shaft 74 if the water invaded the washing shaft 74. Consequently it is possible to prevent the smooth conversion of the floatage clutch 80 by blocking the motion of the float 82.

As described above, the washing machine according to the present invention can provide the following advantages. The power transmission in the conversion from the cleansing step to the dehydrating step can be easily switched due to the floatage clutch of simple structure. Also, since the operation stability of the floatage clutch is improved due to the shielding means, the merchant ability and the productivity thereof can be increased.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A washing machine comprising:

a water tub;

a cleansing basket rotatably contained within the water tub;

a pulsator rotatably mounted on the bottom surface of the cleansing basket, having a wing part for forming a water stream, and a hub part disposed in the center of the wing part;

a motor for generating a driving force required to rotate the cleansing basket and the pulsator;

a transmission for transmitting the driving force of the motor to the cleansing basket and the pulsator, having a hollow dryer shaft integrated to the cleansing basket; and a washing shaft mounted to penetrate the hollow dryer shaft, whose upper end of the transmission is fixed to the hub part of the pulsator, and whose lower end thereof is connected with the motor; and a floatage clutch for allowing the cleansing basket to selectively cooperate with the pulsator by being intermittently actuated depending on the existence and nonexistence of water, having a float engaged with the washing shaft to be capable of moving up and down due to the supply/drain of the water, and a fixed member fixed to the upper end of the hollow dryer shaft to be separated from and coupled with the float at the lower side thereof.

2. The washing machine of claim 1, wherein the float includes a hub portion to be coupled with a serration portion of the washing shaft, and a tube portion constructed around the hub portion, and the hub portion of the float is formed with a convex-concave shape bottom surface, and the tube portion is shaped as a blinded hollow tube, and the fixed member is formed with a convex-concave shape top surface to be engaged with the bottom surface of the hub portion of the float.

3. The washing machine of claim 2, further comprising shielding means on one side of the floatage clutch for preventing a joint region between the float of the floatage clutch and the washing shaft from being in contact with the water.

4. The washing machine of claim 3, wherein the shielding means is shaped as a ring to be protruded at the bottom of the wing part of the pulsator exceeding the cleansing basket downwardly, and includes a water blocking part surrounding the float.

5. The washing machine of claim 1, further comprising shielding means on one side of the floatage clutch for preventing a joint region between the float of the floatage clutch and the washing shaft from being in contact with the water.

6. The washing machine of claim 5, wherein the shielding means is shaped as a ring to be protruded at the bottom of the wing part of the pulsator exceeding the cleansing basket downwardly, and includes a water blocking part surrounding the float.

7. A washing machine comprising:

a cleansing basket;

a pulsator rotatably mounted in the cleansing basket;

a motor for rotating the cleansing basket and the pulsator;

a transmission for transmitting a driving force of the motor to the cleansing basket and the pulsator, the transmission including:

a hollow outer shaft attached to the cleansing basket; and an inner shaft penetrating the hollow outer shaft, an upper end of the inner shaft being fixed to the pulsator, and a lower end of the inner shaft being connected with the motor; and a floatage clutch for allowing the cleansing basket to selectively cooperate with the pulsator by being intermittently actuated depending on the existence and nonexistence of water, the floatage clutch including:

a float engaged with the inner shaft to be capable of moving up and down with the level of water within the cleansing basket; and a fixed member fixed to the upper end of the hollow outer shaft to be separated from and coupled with the float.

8. The washing machine of claim 7, wherein the float includes a hub portion to be coupled with a serration portion of the inner shaft, and a tube portion constructed around the hub portion, and the hub portion of the float is formed with a convex-concave shaped bottom surface, and the tube portion is shaped as a blinded hollow tube, and the fixed member is formed with a convex-concave shaped top surface to be engaged with the bottom surface of the hub portion of the float.

9. The washing machine of claim 8, further comprising a shield on one side of the floatage clutch for preventing a joint region between the float of the floatage clutch and the inner shaft from being in contact with the water.

10. The washing machine of claim 9, wherein the shield is shaped as a ring to be protruded at the bottom of the pulsator exceeding the cleansing basket downwardly, and includes a water blocking part surrounding the float.

11. The washing machine of claim 7, further comprising a shielding on one side of the floatage clutch for preventing a joint region between the float of the floatage clutch and the inner shaft from being in contact with the water.

12. The washing machine of claim 11, wherein the shield is shaped as a ring to be protruded at the bottom of the pulsator exceeding the cleansing basket downwardly, and includes a water blocking part surrounding the float.

* * * * *